US010374314B2

(12) United States Patent
Iino

(10) Patent No.: US 10,374,314 B2
(45) Date of Patent: Aug. 6, 2019

(54) COMPOSITE PATCH ANTENNA DEVICE

(71) Applicant: HARADA INDUSTRY CO., LTD., Tokyo (JP)

(72) Inventor: Shinji Iino, Tokyo (JP)

(73) Assignee: HARADA INDUSTRY CO., LTD., Tokyo (JP)

( * ) Notice: Subject to any disclaimer, the term of this patent is extended or adjusted under 35 U.S.C. 154(b) by 0 days.

(21) Appl. No.: 15/776,648

(22) PCT Filed: Nov. 18, 2016

(86) PCT No.: PCT/JP2016/084369
§ 371 (c)(1),
(2) Date: May 16, 2018

(87) PCT Pub. No.: WO2017/086480
PCT Pub. Date: May 26, 2017

(65) Prior Publication Data

US 2018/0331428 A1 Nov. 15, 2018

(30) Foreign Application Priority Data

Nov. 19, 2015 (JP) ..... 2015-227104

(51) Int. Cl.
*H01Q 1/38* (2006.01)
*H01Q 9/04* (2006.01)
(Continued)

(52) U.S. Cl.
CPC ..... *H01Q 9/0414* (2013.01); *H01Q 1/48* (2013.01); *H01Q 5/35* (2015.01); *H01Q 9/0428* (2013.01);
(Continued)

(58) Field of Classification Search
CPC ..... H01Q 1/48; H01Q 21/24; H01Q 21/30; H01Q 3/35; H01Q 1/32; H01Q 9/0414; H01Q 9/0435
See application file for complete search history.

(56) References Cited

U.S. PATENT DOCUMENTS 5,243,353 A * 9/1993 Nakahara ..... H01Q 9/0457 343/700 MS
7,277,056 B1 * 10/2007 Thiam ..... H01Q 9/0414 343/700 MS
(Continued)

FOREIGN PATENT DOCUMENTS

JP 2006-310951 A 11/2006
JP 2012-503382 A 2/2012

OTHER PUBLICATIONS

International Search Report in PCT/JP2016/084369 dated Dec. 27, 2016.

*Primary Examiner* — Dieu Hien T Duong
(74) *Attorney, Agent, or Firm* — Global IP Counselors, LLP

(57) ABSTRACT

A composite patch antenna composite patch antenna device is capable of receiving signals in multiple frequency bands. The composite patch antenna composite patch antenna device includes a circuit board, a gap patch antenna, and a dielectric patch antenna. The gap patch antenna has a radiation element that is disposed in parallel with a predetermined air gap with respect to the circuit board, that has a hole section passing through substantially a center. The dielectric patch antenna is stacked on the radiation element of the gap patch antenna in the state of being electrically insulated, and has a second feeding line that is connected to the radiation electrode and that is connected to the second feeding section the circuit board by passing through the
(Continued)

through-hole of the dielectric layer and the hole section of the radiation element of the gap patch antenna.

10 Claims, 2 Drawing Sheets

(51) Int. Cl.

| | |
|---|---|
| ***H01Q 21/24*** | (2006.01) |
| ***H01Q 5/35*** | (2015.01) |
| ***H01Q 1/48*** | (2006.01) |
| ***H01Q 21/30*** | (2006.01) |
| *H01Q 1/32* | (2006.01) |

(52) U.S. Cl.
CPC ..... *H01Q 9/0435* (2013.01); *H01Q 21/24* (2013.01); *H01Q 21/30* (2013.01); *H01Q 1/32* (2013.01)

(56) References Cited

U.S. PATENT DOCUMENTS

2004/0201523 A1* 10/2004 Yuanzhu ..... H01Q 1/3275 343/700 MS
2006/0066488 A1 3/2006 Zhinong

* cited by examiner

COMPOSITE PATCH ANTENNA DEVICE

This application is a U.S. National stage application of International Application No. PCT/JP2016/084369, filed Nov. 18, 2016, which claims priority to Japanese Patent Application No. 2015-227104 filed on Nov. 19, 2015.

BACKGROUND

Technical Field

The present invention relates to a composite patch, antenna device, and more particularly to a composite patch antenna device that includes stacked patch antennas so as to be able to receive signals in multiple frequency bands.

Background Information

In recent years, a variety of antennas have been mounted on a vehicle. Antennas mounted on a vehicle include those necessary for achieving a variety of types of communication for, for example, a radio, a television, a mobile phone, a global positioning system (GPS), an electronic toll collection system (ETC), and a vehicle information and communication system (VICS, registered trademark). Although a vehicle roof is most preferable in view of a receiving condition, an antenna attached to a vehicle roof spoils the appearance of the vehicle and work of attaching an antenna to a vehicle roof is complicated. For this reason, an antenna is housed in the dashboard of a vehicle or attached to a glass portion of a vehicle. Reduction in weight has been an object required of recent vehicles, and accordingly, size reduction of an antenna device has been demanded.

In recent years, operation of services, such as comprehensive safe driving support, has been promoted by combining positional information obtained from a GPS antenna and information on, e.g., traffic jams obtained from a side strip by a dedicated short range communications (DSRC) antenna. In such a system, a GPS antenna for position measurement and a DSRC antenna for obtaining traffic jam information are necessary. However, mounting a plurality of antennas on a vehicle brings about problems, such as increase of antenna attaching area and complicated attaching work. In view of the above, a composite antenna device that is reduced in size by integrating a plurality of antennas has been developed (e.g., see Japanese Patent Application Kokai Publication No. 2003-163531 A). In this composite antenna device, an ETC patch antenna is disposed on an inner side of a loop of a GPS loop antenna. A stack antenna, in which a plurality of patch antennas using ceramic, a dielectric substrate, and the like are stacked so that signals in multiple frequency bands can be received, has also been known (e.g., see Japanese Patent Application Kokai Publication No. 2010-226633 A, Japanese Patent Application Kokai Publication No. 2001-244726 A and Japanese Patent Application Kokai Publication No. Hei 06-350332 A).

SUMMARY

However, all of conventional stack antennas are designed to be installed in a dashboard. Accordingly, if a dielectric patch antenna such as a conventional ETC patch antenna is used, the antenna attached to, for example, the windshield of a vehicle is influenced by glass which is a dielectric material and, therefore, a bandwidth of sufficient gain and axial ratio cannot be obtained. Also, an ETC patch antenna using a dielectric material, such as ceramic, is not suitable when used in a stacked manner because of its narrow bandwidth.

An object of the present invention, therefore, is to overcome the problems existing in the prior art, and to provide a composite patch antenna device that can be compact with a wide bandwidth, and is usable when installed in a dashboard or attached to glass.

To achieve the above object, of the present invention, a composite patch antenna device according to the present invention may include a circuit board to which a cable from external equipment is connected and on which an amplifier circuit is placed, the circuit board having a first feeding section for a first frequency band, a second feeding section for a second frequency band different from the first frequency band, and a ground plate disposed on a surface opposite to a surface on which the amplifier circuit is placed; a gap patch antenna, corresponding to the first frequency band, the gap patch antenna having a radiation element that is disposed in parallel with the circuit board with a predetermined air gap with respect to the circuit hoard, that has a hole section passing through substantially a center of the radiation element, and that constitutes a circularly polarized, wave microstrip antenna together with the ground plate of the circuit board, and a first feeding line that is configured of the same member as the radiation element, that extends from a peripheral section of the radiation element, and that is connected to the first feeding section of the circuit board; and a dielectric patch antenna corresponding to the second frequency band and being stacked on the radiation element of the gap patch antenna in the state of being electrically insulated from the radiation element, the dielectric patch antenna having a dielectric layer, that has a through-hole, a radiation electrode that is disposed on one surface of the dielectric layer, a ground electrode that is disposed on the other surface of the dielectric layer and that has a hole section at a position corresponding to the through-hole of the dielectric layer, and a second feeding line that is connected to the radiation electrode and that is connected to the second feeding section of the circuit board by passing through the through-hole of the dielectric layer, the hole section of the ground electrode and the hole section of the radiation element of the gap patch antenna.

The dielectric patch antenna may be disposed in which the radiation electrode is disposed in such a way as to be rotated around the second feeding line with respect to the radiation element of the gap patch antenna by a predetermined angle for improving an antenna characteristic.

A cable connected to the circuit board may be connected in such, a manner that a longitudinal direction thereof is orthogonal to a peripheral section of the circuit board, and the first feeding line of the gap patch antenna may extend from a peripheral section of the radiation element in an orthogonal direction with respect to an extended axis in the longitudinal direction of the cable connected to the circuit board.

The first frequency hand of the circuit board may be higher than the second frequency band.

The first frequency band of the circuit board may be lower than the second frequency band.

The composite patch antenna device according to the present invention has such advantages that it can be compact with a wide bandwidth, and is usable when installed in a dashboard or attached to glass.

BRIEF DESCRIPTION OF THE DRAWINGS

Referring now to the drawings, examples of a composite patch antenna device are illustrated.

DETAILED DESCRIPTION OF THE EMBODIMENTS

Figure 1:
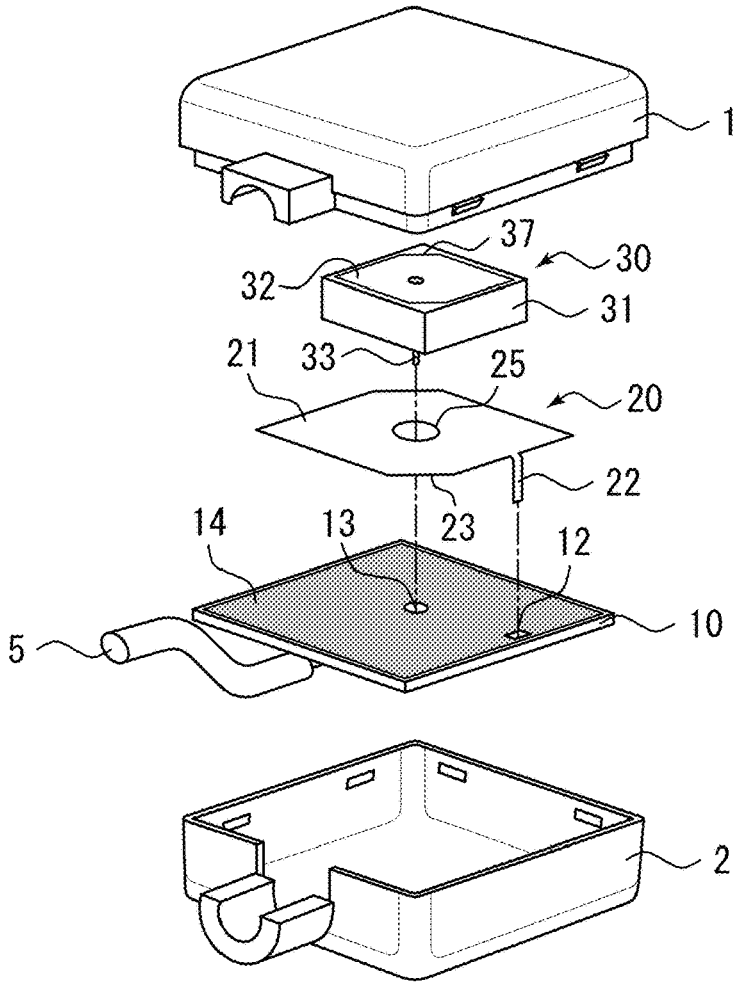
FIG. 1 is a schematic exploded perspective view for explaining a composite patch antenna device according to the present invention.
Figure 2:
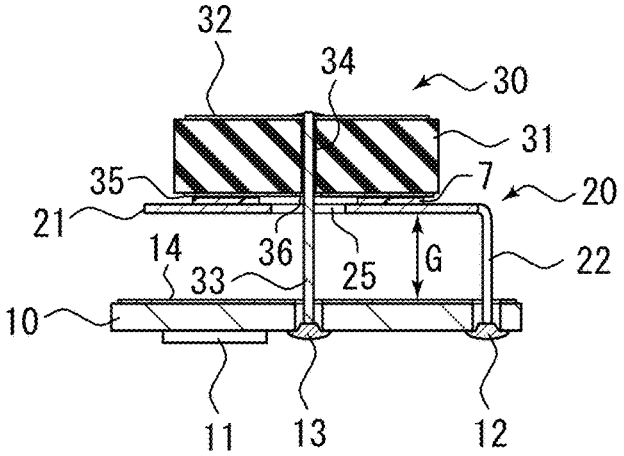
FIG. 2 is a schematic horizontal cross-sectional view of a section around the center for explaining the composite patch antenna device according to the present invention.

Hereinafter, an embodiment for practicing the present invention will be described with reference to the accompanying drawings. FIG. 1 is a schematic exploded perspective view for explaining a composite patch antenna device according to the present invention capable of receiving signals in multiple frequency bands. FIG. 2 is a schematic horizontal cross-sectional view of a section around the center for explaining the composite patch antenna device according to the present invention. In the drawing, the same reference numerals as those in FIG. 1 denote the same parts as those in FIG. 1. In FIG. 2, a case is omitted. As illustrated, the composite patch antenna device according to the present invention is mainly configured with a circuit board 10, a gap patch antenna 20, and a dielectric patch antenna 30. The circuit board 10, the gap patch antenna 20, and the dielectric patch antenna 30 are stacked and housed in a pair of cases 1 and 2. A cable 5 is connected to external equipment (not shown), such as a DSRC transmitter and receiver.

The cable 5 from the external equipment is connected to the circuit board 10. As shown in FIG. 2, an amplifier circuit 11 is placed on the circuit board 10. The circuit board 10 includes a first feeding section 12 for a first frequency band and a second feeding section 13 for a second frequency band that is, for example, lower than the first frequency band. Specifically, the first frequency band is, tier example, a 5.8 GHz ETC/DSRC band. The second frequency band is, for example, a 1.5 GHz GPS band. A ground plate 14 is disposed on one surface of the circuit board 10. As shown in FIG. 2, the amplifier circuit 11 is placed on a back surface, and the ground plate 14 is disposed on a surface opposite to the surface on which the amplifier circuit 11 is placed. The amplifier circuit 11 may be configured of an IC chip, or assembled with discrete parts and the like. The ground plate 14 functions as a ground of an electric circuit placed on the circuit board 10, such as the amplifier circuit 11. The ground plate 14 also has a function as a ground plane of the gap patch antenna 20 described later. The first feeding section 12 and the second feeding section 13 may be provided with a through-hole and the like in a state where they are electrically insulated from the ground plate 14.

The gap patch antenna 20 is an antenna corresponding to the first frequency band. For example, the gap patch antenna 20 is an ETC/DSRC antenna. The gap patch antenna 20 includes a radiation element 21 and a first feeding line 22. The radiation element 21 is disposed in parallel with the circuit board 10 with a predetermined air gap G between them. The radiation element 21 constitutes a microstrip antenna together with the ground plate 14 of the circuit board 10 by being disposed in the above manner. The first feeding line 22 is connected to the radiation element 21 and connected to the first feeding section 12 of the circuit board 10.

Specifically, a principal part of the radiation element 21 has a substantially square shape, each side of which has a length of $\lambda/2$. To obtain a circularly polarized wave patch antenna of one-point feeding type, degeneracy separation element sections 23 are loaded in corner areas at opposite angles of the radiation element 21. The degeneracy separation element sections 23, which are for shifting the balance of two polarized waves orthogonal with each other that are generated in the radiation element 21, may be a notch, a projecting section, or the like. The radiation element 21 further includes a hole section 25 that passes through substantially the center of the radiation element 21. As described later, a second feeding line 33 passes through the hole section 25 in the state of being electrically insulated from the hole section 25. The radiation element 21 may be formed by sheet metal processing, such as cutting a copper plate.

The first feeding line 22 is connected to the first feeding section 12 of the circuit board 10. In the drawing, an example is shown in which the first feeding line 22 extends from a peripheral section of the radiation element 21. Specifically, the first feeding line 22 extends from a peripheral section which is not parallel to a longitudinal direction of the cable 5 connected to the circuit board 10 when viewed from the center of the radiation element 21. Specifically, the first feeding line 22 extends from a side which is different from a side on which the cable 5 is connected. In this manner, interference with the cable 5 is avoided. In the present invention, the first feeding line 22 may be configured to the degree sufficient to avoid mutual influence between the first feeding line 22 and the cable 5. Accordingly, the first feeding line 22 may be disposed at any location other than, e.g., directly above the cable 5.

The first feeding line 22 may be configured with the same member as, for example, the radiation element 21. That is, for example, the radiation element 21 and the first feeding line 22 can be formed integrally by sheet metal processing such as folding after cutting, e.g., a copper plate. With this configuration, the radiation element 21 of the gap patch antenna 20 can be effectively used, and a conductor loss at a feeding position of the first feeding line 22 is minimized.

The dielectric patch antenna 30 is stacked on the gap patch antenna 20 in the state of being electrically insulated, from the gap patch antenna 20. In the illustrated example, the dielectric patch antenna 30 is stacked on the radiation element 21 of the gap patch antenna 20. The dielectric patch antenna 30 may be placed in the state of being electrically insulated by an adhesive 7, such as a double sided tape. The dielectric patch antenna 30 corresponds to the second frequency band. For example, the dielectric patch antenna 30 is a GPS antenna. The dielectric patch antenna 30 includes a dielectric layer 31, a radiation electrode 32, and the second feeding line 33. The dielectric layer 31 includes a through-hole 34. The through-hole 34 is configured to allow the second feeding line 33 to pass through. The dielectric layer 31 may be made from, for example, a ceramic plate.

The radiation electrode 32 is disposed on a first surface of the dielectric layer 31. Specifically, the radiation electrode 32 is disposed on a surface of the dielectric layer 31 facing the radiation element 21 side of the gap patch antenna 20. Specifically, the radiation electrode 32 has a square shape with a side of around 11 mm in length. For the radiation electrode 32 as well, degeneracy separation element sections are loaded in corner areas at opposite angles of the radiation electrode 32 to obtain a circularly polarized wave patch antenna of one-point feeding type. In the illustrated example, a ground electrode 35 is disposed on a second surface of the dielectric layer 31. The ground electrode 35 includes a hole section 36 corresponding to the through-hole 34 of the dielectric layer 31. The radiation electrode 32 constitutes a microstrip antenna together with the ground electrode 35. The composite patch antenna device according to the present invention is not limited to the above configuration, and the radiation electrode 32 of the dielectric patch antenna 30 may constitute a microstrip antenna together with the ground plate 14 of the circuit board 10.

The second feeding line 33 is connected to the radiation electrode 32. Specifically, the second feeding line 33 is connected to substantially the center of the radiation electrode 32, and more specifically connected to a section little bit shifted from the center. The second feeding line 33 is thus connected for receiving a right-handed circularly polarized wave. The second feeding line 33 passes through the through-hole 34 of the dielectric layer 31 and the hole section 25 of the radiation element 21 of the gap patch antenna 20 to be connected to the second feeding section 13 of the circuit board 10. More specifically, the second feeding line 33 connected to substantially the center of the radiation electrode 32 passes through the through-hole 34 of the dielectric layer 31 toward a section directly below, that is, the circuit board 10 side, and passes through the hole section 36 of the ground electrode 35, and then further passes through the hole section 25 of the radiation element 21 of the gap patch antenna 20 to be connected to the second feeding section 13 of the circuit board 10. As described above, the second feeding line 33 is connected to the second feeding section 13 linearly from the radiation element 32 in the state of being not electrically connected to and insulated from not only the hole 36 of the ground electrode 35 but also the hole section 25 of the radiation element 21 of the gap patch antenna 20. The hole section 25 of the radiation element 21 of the gap patch antenna 20 is larger than the hole section 36 of the ground electrode 35. By making the size of the hole section 25 as large as not having any effect on the second feeding line 33, antenna performance of the gap patch antenna 20 can be improved.

In the composite patch antenna device according to the present invention, the gap patch antenna 20 and the dielectric patch antenna 30 are stacked as described above. In this manner, the composite patch antenna device according to the present invention can be reduced in size and disposed in a space-saving dashboard. The patch antenna device according to the present invention configured as described above which is attached to glass shows an excellent axial ratio characteristic over a frequency band used for an ETC and DSRC as compared with conventionally widely-used patch antenna devices.

In the composite patch antenna device according to the present invention, an LED, a speaker, and the like may also be disposed on the amplifier circuit 11 side of the circuit board 10 as needed. In this manner, when the composite patch antenna device is attached to the windshield of a vehicle, predetermined information can be provided to the driver by light and sound.

In the above illustrated example, an explanation is given on the configuration where the first frequency band of the circuit board 10 is higher than the second frequency hand. That is, the gap patch antenna 20 is used for the first frequency band which is, for example, a frequency band for an ETC and DSRC, and the dielectric patch antenna 30 is used for the second frequency band which is, for example, a frequency band for a OPS. However, the present invention is not limited to the above configuration, and the first frequency band may be lower than the second frequency band. That is, specifically, the gap patch antenna 20 is used for the first frequency band which is, for example, a frequency band for a GPS, and the dielectric patch antenna 30 is used for the second frequency band which is, for example, a frequency band for an ETC and DSRC. Alternatively, the first frequency band may be, for example, a frequency band for a GNSS, and the second frequency band may be, for example, a frequency band for a satellite digital audio radio service (SDARS).

Figure 3:
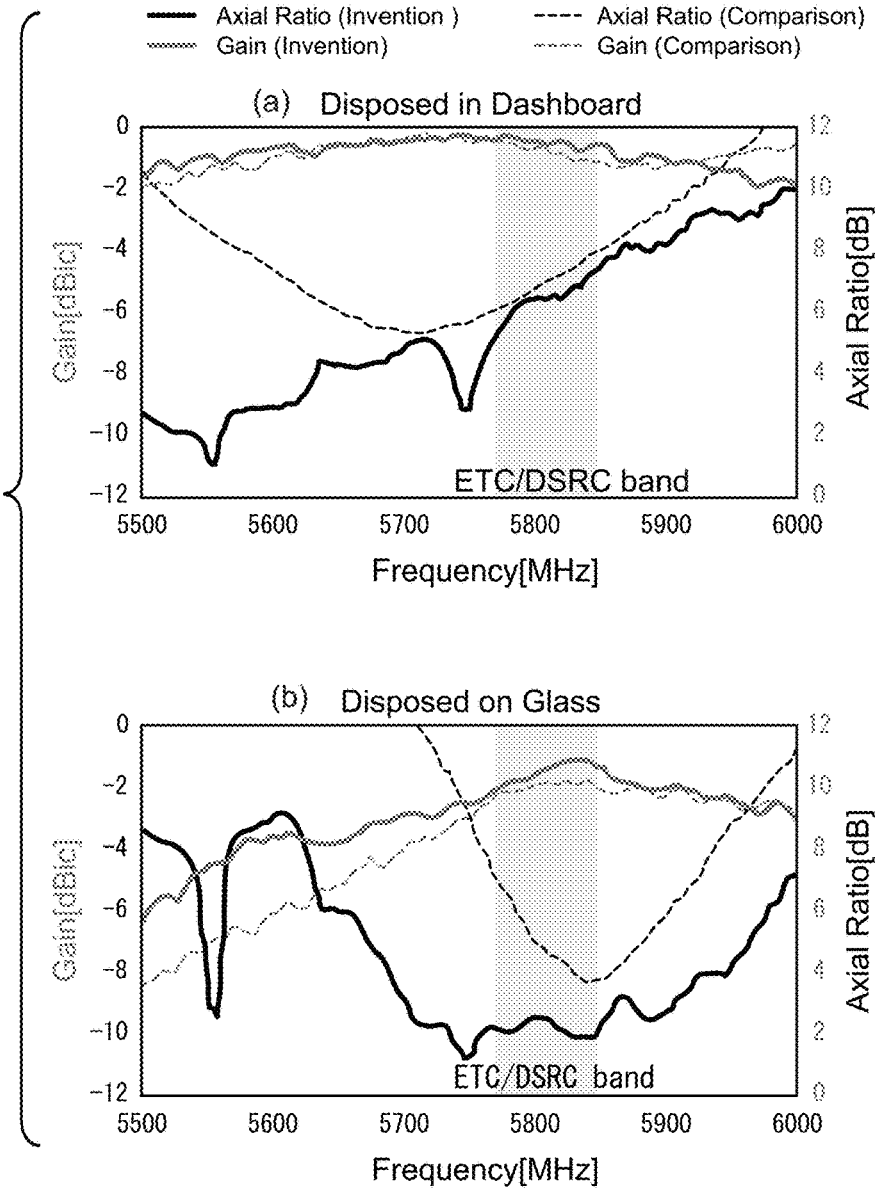
FIG. 3 is gain and axial ratio characteristics graphs in an ETC/DSRC bands of the composite patch antenna device according to the present invention.

FIG. 3 shows gain and axial ratio characteristics graphs in an ETC/DSRC band of the composite patch antenna device according to the present invention. The illustrated examples are for comparing gain and axial ratio characteristics of a gap patch antenna section of the composite patch antenna device according to the present invention and gain and axial ratio characteristics of a gap patch antenna as a single body of a comparison example. That is, characteristics in ETC and DSRC bands of a gap patch antenna section of the composite patch antenna device according to the present invention are compared with characteristics in ETC and DSRC bands of a general single-body gap patch antenna of a comparison example. In FIG. 3, comparisons are made for a case where the antennas are disposed in a dashboard (a) and a case where the antennas are disposed on glass (b). A solid line shows characteristics of the present invention, and a broken line shows characteristics of the comparison example.

As shown in the drawing, the composite patch antenna device according to the present invention exhibits excellent gain and axial ratio as compared with the comparison example not only in the case where the antennas are disposed, in a dashboard but also in the case where the antennas are disposed on glass. Accordingly, the composite patch antenna device according to the present invention is usable both when installed in a dashboard and attached to glass.

Figure 4:
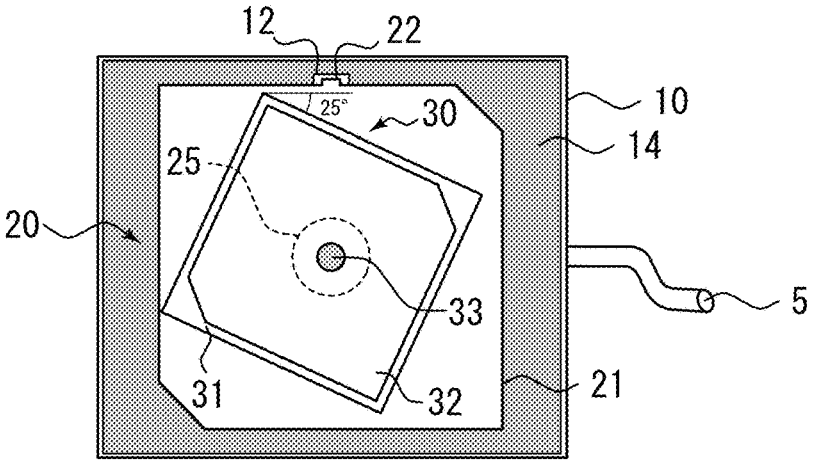
FIG. 4 is a schematic top view for explaining another example of the composite patch antenna device according to the present invention.

Next, an explanation will be given of further improvement in characteristics of the composite patch antenna device according to the present invention. FIG. 4 is a schematic top view for explaining another example of the composite patch antenna device according to the present invention. In the drawing, the same reference numerals as those in FIGS. 1 and 2 denote the same parts as those in FIGS. 1 and 2. The cases shown in FIG. 1 are omitted in FIG. 4. In the illustrated example, the dielectric patch antenna 30 is disposed in such a manner that the radiation electrode 32 is rotated around the second feeding line 33 by a predetermined angle with respect to the radiation element 21 of the gap patch antenna 20. As shown in the drawing, the second feeding line 33 is disposed to pass through the hole section 25 that is disposed around the center of the radiation element 21. To rotate the radiation electrode 32, in the simplest way, the dielectric patch antenna 30 itself may be rotated around the second feeding line 33 by a predetermined angle as shown in the illustrated example. However, the present invention is not limited to the above configuration, and the radiation electrode 32 in a rotated state may be disposed on the dielectric layer 31, without rotating the dielectric layer 31. When the dielectric patch antenna 30 is rotated by a predetermined angle as described above, the characteristic of the gap patch antenna 20 can be adjusted. More specifically, when, for example, the radiation electrode 32 is in a state of being, tilted by 25 degrees, the antenna characteristic becomes most excellent. As described above, the composite patch antenna device according to the present invention has an antenna characteristic which can be adjusted depending on an angle at which the dielectric patch antenna is disposed.

The composite patch antenna device according to the present invention is is not limited to the illustrated examples described above, but various modification may be made within the scope of the present invention.

The invention claimed is:

1. A composite patch antenna device capable of receiving signals in multiple frequency bands, comprising:

a circuit board to which a cable from external equipment is connected and on which an amplifier circuit is placed, the circuit board having a first feeding section for a first frequency band, a second feeding section for a second frequency band different from the first frequency band, and a ground plate disposed on a surface opposite to a surface on which the amplifier circuit is placed;

a gap patch antenna corresponding to the first frequency band, the gap patch antenna having a radiation element that is disposed in parallel with the circuit board with a predetermined air gap with respect to the circuit board, that has hole section passing through substantially a center of the radiation element, and that constitutes a circularly polarized wave microstrip antenna together with the ground plate of the circuit board, and a first feeding line that is configured of the same member as the radiation element, that extends from a peripheral section of the radiation element, and that is connected to the first feeding section of the circuit board; and a dielectric patch antenna corresponding to the second frequency band and being stacked on the radiation element of the gap patch antenna in the state of being electrically insulated from the radiation element, the dielectric patch antenna having a dielectric layer that has a through-hole, a radiation electrode that is disposed on one surface of the dielectric layer, a ground electrode that is disposed on the other surface of the dielectric layer and that has a hole section at a position corresponding to the through-hole of the dielectric layer, and a second feeding line that is connected to the radiation electrode and that is connected to the second feeding section of the circuit board by passing through the through-hole of the dielectric layer, the hole section of the ground electrode and the hole section of the radiation element of the gap patch antenna.

2. The composite patch antenna device according to claim 1, wherein the dielectric patch antenna is disposed in which the radiation electrode is disposed to be rotated around the second feeding line with respect to the radiation element of the gap patch antenna by a predetermined angle for improving an antenna characteristic.

3. The composite patch antenna device according to claim 2, wherein a cable connected to the circuit board is connected in such that a longitudinal direction thereof is orthogonal to a peripheral section of the circuit board, and the first feeding line of the gap patch antenna extends from a peripheral section of the radiation element in an orthogonal direction with respect to an extended axis in the longitudinal direction of the cable connected to the circuit board.

4. The composite patch antenna device according to claim 2, wherein the first frequency band of the circuit board is higher than the second frequency band.

5. The composite patch antenna device according to claim 2, wherein the first frequency band of the circuit board is lower than the second frequency band.

6. The composite patch antenna device according to claim 1, wherein a cable connected to the circuit board is connected in such that a longitudinal direction thereof is orthogonal to a peripheral section of the circuit board, and the first feeding line of the gap patch antenna extends from a peripheral section of the radiation element in an orthogonal direction with respect to an extended axis in the longitudinal direction of the cable connected to the circuit board.

7. The composite patch antenna device according to claim 6, wherein the first frequency band of the circuit board is higher than the second frequency band.

8. The composite patch antenna device according to claim 6, wherein the first frequency band of the circuit board is lower than the second frequency band.

9. The composite patch antenna device according to claim 1, wherein the first frequency band of the circuit board is higher than the second frequency band.

10. The composite patch antenna device according to claim 1, wherein the first frequency band of the circuit board is lower than the second frequency band.

* * * * *